US011898439B2

(12) United States Patent
Al-Mousa et al.

(10) Patent No.: US 11,898,439 B2
(45) Date of Patent: Feb. 13, 2024

(54) DOUBLE-LAYERED WELLBORE TUBULAR ASSEMBLY

(71) Applicant: Saudi Arabian Oil Company, Dhahran (SA)

(72) Inventors: Ahmed Abdulaziz Al-Mousa, Doha (SA); Omar M. Al Hamid, Dammam (SA); Mohamed A. Al Ammari, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/751,968

(22) Filed: May 24, 2022

(65) Prior Publication Data

US 2023/0383645 A1 Nov. 30, 2023

(51) Int. Cl.

| | |
|---|---|
| ***E21B 47/10*** | (2012.01) |
| ***E21B 17/18*** | (2006.01) |
| ***E21B 47/06*** | (2012.01) |
| ***E21B 17/00*** | (2006.01) |

(52) U.S. Cl.

CPC ..... *E21B 47/10* (2013.01); *E21B 17/003* (2013.01); *E21B 17/18* (2013.01); *E21B 47/06* (2013.01)

(58) Field of Classification Search

CPC ..... E21B 47/10; E21B 47/06; E21B 17/003; E21B 17/18

See application file for complete search history.

(56) References Cited

U.S. PATENT DOCUMENTS

| | | | | |
|---|---|---|---|---|
| 9,562,339 | B2 | 2/2017 | Kiest et al. | |
| 9,896,380 | B2 | 2/2018 | Frantz et al. | |
| 11,286,746 | B2 * | 3/2022 | Ross | E21B 47/14 |
| 2014/0367102 | A1 * | 12/2014 | Larsen | E21B 33/13 166/285 |
| 2015/0136492 | A1 * | 5/2015 | Speer | E21B 17/1078 175/102 |
| 2016/0160635 | A1 * | 6/2016 | Langseth | G01M 3/283 73/49.1 |
| 2021/0148199 | A1 * | 5/2021 | Thiruvenkatanathan | E21B 43/121 |
| 2021/0156244 | A1 * | 5/2021 | Hoeie | E21B 47/007 |
| 2023/0080453 | A1 * | 3/2023 | Idris | E21B 47/10 166/250.01 |

FOREIGN PATENT DOCUMENTS

| | | |
|---|---|---|
| CA | 2514492 | 10/2012 |

* cited by examiner

*Primary Examiner* — Brad Harcourt
(74) *Attorney, Agent, or Firm* — Fish & Richardson P.C.

(57) ABSTRACT

A double-layered wellbore tubular assembly includes a first wellbore tubular configured to be lowered into and installed within a wellbore. The first wellbore tubular has an inner diameter and defines a first hollow volume. The assembly includes a second wellbore tubular configured to be lowered into and installed within the first hollow volume of the first wellbore tubular. The second wellbore tubular has an outer diameter smaller than the inner diameter of the first wellbore tubular. The second wellbore tubular installed within the first hollow volume defines a tubing-to-tubing annulus (TTA) between an outer wall of the second wellbore tubular and an inner wall of the first wellbore tubular.

9 Claims, 4 Drawing Sheets

DOUBLE-LAYERED WELLBORE TUBULAR ASSEMBLY

TECHNICAL FIELD

This application relates to wellbore tubing assemblies, for example, assemblies that include wellbore tubulars.

BACKGROUND

Hydrocarbons entrapped in subsurface reservoirs can be produced to the surface by forming wellbores from the surface to the subsurface reservoirs through subterranean zones (e.g., a formation, a portion of a formation or multiple formations). In operation, wellbore tubulars are installed within the wellbores, and the hydrocarbons are flowed through the wellbore tubulars to the surface. Over time, the tubulars can develop cracks, e.g., due to contact with corrosive hydrocarbons that contain hydrogen sulfide, due to wellbore conditions (e.g., high temperature and pressure), other factors or a combination of them. The hydrocarbons or other wellbore fluids can leak through the cracks, resulting in losses.

SUMMARY

This disclosure describes technologies relating to a double-layered wellbore tubular assembly.

Certain aspects of the subject matter described here can be implemented as a method. A wellbore assembly is formed by installing a second wellbore tubular within a hollow volume defined by a first wellbore tubular. The second wellbore tubular installed within the hollow volume defines a tubing-to-tubing annulus (TTA) between an outer wall of the second wellbore tubular and an inner wall of the first wellbore tubular. The wellbore assembly is installed within a wellbore. While performing wellbore operations within the wellbore, a pressure within the TTA is periodically measured. Based on a result of periodically measuring the pressure within the TTA, a leak is determined in the second wellbore tubular.

An aspect combinable with any other aspects can include the following features. To periodically measure the pressure within the TTA, a pressure cable is installed within the TTA when forming the wellbore assembly. The pressure cable is coupled to a pressure gauge installed at a surface of the wellbore.

An aspect combinable with any other aspects can include the following features. Based on the result of periodically measuring the pressure within the TTA, to determine the leak in the second wellbore tubular, it is determined that the pressure within the TTA exceeds a pressure threshold.

An aspect combinable with any other aspects can include the following features. The leak is determined at a first time instant. At a second time instant different from the first time instant, an absence of the leak in the second wellbore tubular is determined based on the result of periodically measuring the pressure within the TTA.

An aspect combinable with any other aspects can include the following features. To determine the absence of the leak, it is determined that the pressure within the TTA does not exceed the pressure threshold.

An aspect combinable with any other aspects can include the following features. When determining the leak in the second wellbore tubular, a presence of a crack in an outer wall of the second wellbore tubular is determined. In response, sealing material to seal the crack is pumped from a surface of the wellbore and into the TTA.

An aspect combinable with any other aspects can include the following features. Performing wellbore operations within the wellbore includes producing wellbore fluids comprising hydrocarbons through the wellbore assembly.

Certain aspects of the subject matter described here can be implemented as a wellbore assembly. The assembly includes a first wellbore tubular and a second wellbore tubular. The first wellbore tubular is configured to be lowered into and installed within a wellbore. The first wellbore tubular has an inner diameter and defines a first hollow volume. The second wellbore tubular is configured to be lowered into and installed within the first hollow volume of the first wellbore tubular. The second wellbore tubular has an outer diameter smaller than the inner diameter of the first wellbore tubular. The second wellbore tubular installed within the first hollow volume defines a tubing-to-tubing annulus (TTA) between an outer wall of the second wellbore tubular and an inner wall of the first wellbore tubular.

An aspect combinable with any other aspects can include the following features. The assembly includes a pressure gauge coupled to the wellbore assembly to measure a pressure within the TTA.

An aspect combinable with any other aspects can include the following features. The assembly includes a pressure cable positioned within the TTA and coupled to the pressure gauge.

An aspect combinable with any other aspects can include the following features. The first wellbore tubular and the second wellbore tubular have the same length.

An aspect combinable with any other aspects can include the following features. The assembly includes a first connection at a first end of the wellbore assembly. The first connection is attached to the first wellbore tubular and the second wellbore tubular. The first connection is configured to couple the first end of the wellbore assembly to a wellbore tool.

An aspect combinable with any other aspects can include the following features. The assembly includes a second connection at a second end of the wellbore assembly opposite the first end of the wellbore assembly. The second connection is attached to the first wellbore tubular and the second wellbore tubular. The second connection is configured to couple the second end of the wellbore assembly to a well tool.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

After certain years of using a wellbore tubular to perform wellbore operations such as producing hydrocarbons through a wellbore, corrosion or erosion can cause a crack to form on the wall of the tubular resulting in leak of the hydrocarbons or other wellbore fluids. This disclosure describes forming the wellbore tubular assemblies that are double-layered, thereby increasing the working life of such assemblies and decreasing well downtime. Implementing the techniques described in this disclosure can prevent or delay wellbore tubular wash-out during production time. Implementing the techniques can also prevent wellbore fluid leak into the tubing-to-casing annulus.

Figure 1:
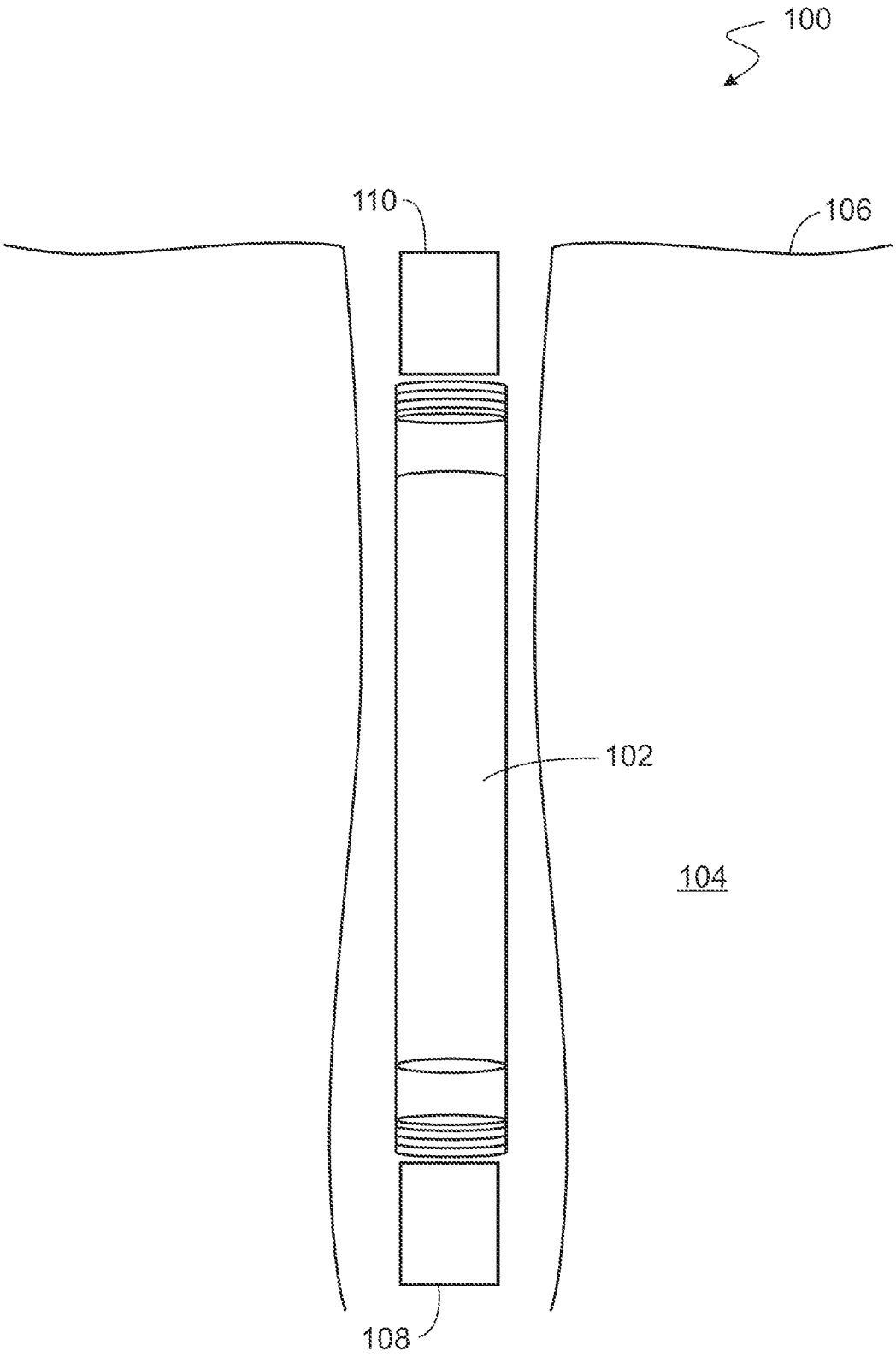
FIG. 1 is a schematic diagram of a wellbore in which a wellbore tubular assembly is installed.

FIG. 1 is a schematic diagram of a wellbore 100 in which a wellbore tubular assembly 102 is installed. The wellbore 100 is formed through a subterranean zone 104 to extend from a surface 106 of the earth to a subsurface reservoir (not shown) in which hydrocarbons entrapped. In operation, hydrocarbons from the subsurface reservoir flow in and uphole direction towards the surface 106 through the assembly 102. The assembly 102 can be coupled to wellbore tools (e.g., a first wellbore tool 108, a second wellbore 110) installed within or outside the wellbore 100, either uphole or downhole of the assembly 102. Examples of such wellbore tools to an electric submersible pump, flow diverters, or similar wellbore tools.

Figure 2A:
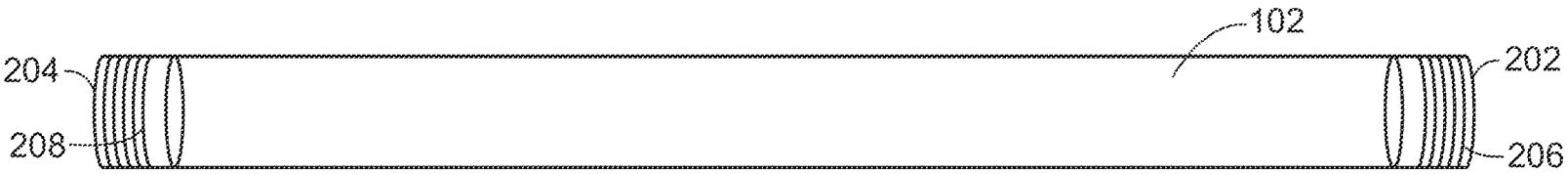
FIG. 2A is a schematic diagram of an external layout of the wellbore tubular assembly of FIG. 1.

FIG. 2A is a schematic diagram of an external layout of the wellbore tubular assembly 102 of FIG. 1. The assembly 102 can be made from any material that can be used in wellbores and through which wellbore fluids including produced hydrocarbons can be flowed. A first end 202 and a second and 204 of the assembly 102 includes a first connection 206 and a second connection 208, respectively, through which the ends of the assembly 102 are attached to wellbore tools such as the first wellbore tool 108 or the second wellbore tool 110, or both. Examples of the first connection and the second connection include threads by which the ends of the assembly 102 can be coupled to corresponding threads of the wellbore tools.

Figure 2B:
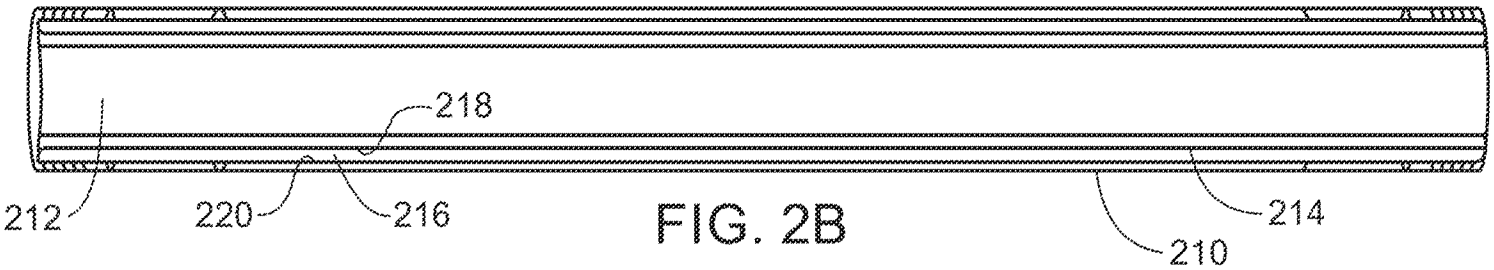
FIG. 2B is a schematic diagram of an internal layout of the wellbore tubular assembly of FIG. 1.

FIG. 2B is a schematic diagram of an internal layout of the wellbore tubular assembly 102 of FIG. 1. The assembly 102 includes a first wellbore tubular 210 that can be lowered into and installed within the wellbore 100. The first wellbore tubular 210 has an inner diameter and defines a first hollow volume 212. The assembly 102 also includes a second wellbore tubular 214 that can be lowered into and installed within the first hollow volume 212 of the first wellbore tubular 210. The second wellbore tubular 214 has an outer diameter that is smaller than the inner diameter of the first wellbore tubular 210. When the second wellbore tubular 214 is installed within the first hollow volume 212, the second wellbore tubular 214 and the first wellbore tubular 210 defined a tubing-to-tubing annulus (TTA) 216 between an outer wall 218 of the second wellbore tubular 214 and the inner wall 220 of the first wellbore tubular 210. The first connection 206 and the second connection 208 can connect the first wellbore tubular 210 and the second wellbore tubular 214 to each other.

For example, the first wellbore tubular 210 can be formed. The second wellbore tubular 214 can be formed to have the same length as the first wellbore tubular 210. The second wellbore tubular 214 can be positioned within the hollow interior volume 212. The first connection 206 and the second connection 208 can each be formed to have an outer diameter at least equal to that of the first tubular 210. Each connection can have a wall thickness such that the wall of each connection can contact both the first tubular 210 and the second tubular 214. Each connection can then be welded (or similarly connected to) to respective ends of the two tubulars such that an end of each tubular is attached to a connection at that and.

Figure 3:
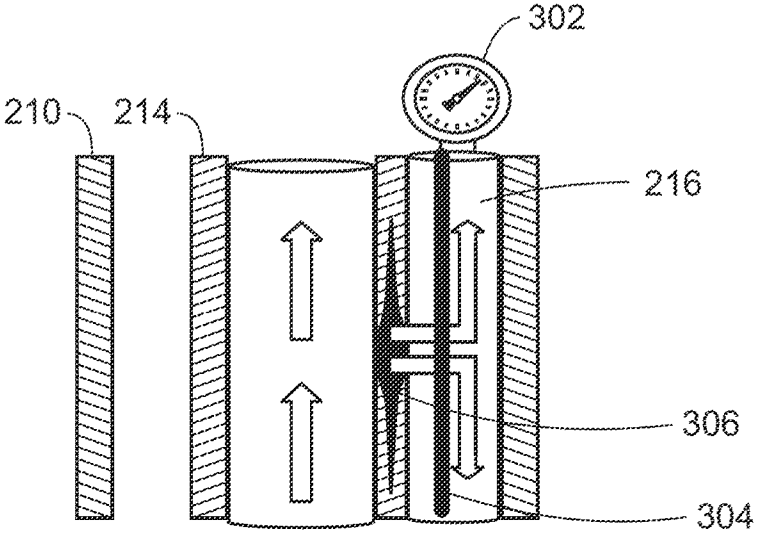
FIG. 3 is a schematic diagram of measuring pressure in the tubular-two-tubular annulus of the wellbore tubular assembly of FIG. 1.

FIG. 3 is a schematic diagram of measuring pressure in the TTA 216 of the wellbore tubular assembly 102 of FIG. 1. In some implementations, a pressure gauge 302 can be coupled to the assembly 102 to measure a pressure within the TTA 216. For example, a pressure cable 304 can be positioned within the TTA 216. In some implementations, the pressure cable 304 can be positioned within the TTA 216 when forming the assembly 102. In some implementations, the pressure cable 304 can be positioned within the TTA 216 after installing the assembly 102 in the wellbore. Based on transmissions through the pressure cable 304, the pressure gauge 302 can measure the pressure in the TTA 216. Over time, in response to the wellbore operations or contact with the hydrocarbons or other wellbore fluids, the wall of the second wellbore tubular 214 (i.e., the inner wellbore tubular) can erode resulting in a crack 306 forming in the wall of the second wellbore tubular 214. The hydrocarbons or the wellbore fluids can flow through the crack 306 into the TTA 216. Such flow can change the pressure within the TTA 216. The pressure gauge 302 can measure the changed pressure, thereby indicating a leak into the TTA 216.

In some implementations, upon determining a leak into the TTA 216, a wellbore operator can stop wellbore operations, and take corrective action to fix the leak. For example, the wellbore operator can remove the assembly 102 from within the wellbore 100 for repair or replacement. In some implementations, the wellbore operator can repair the leak without removing the assembly 102 from within the wellbore 100.

Figure 4B:
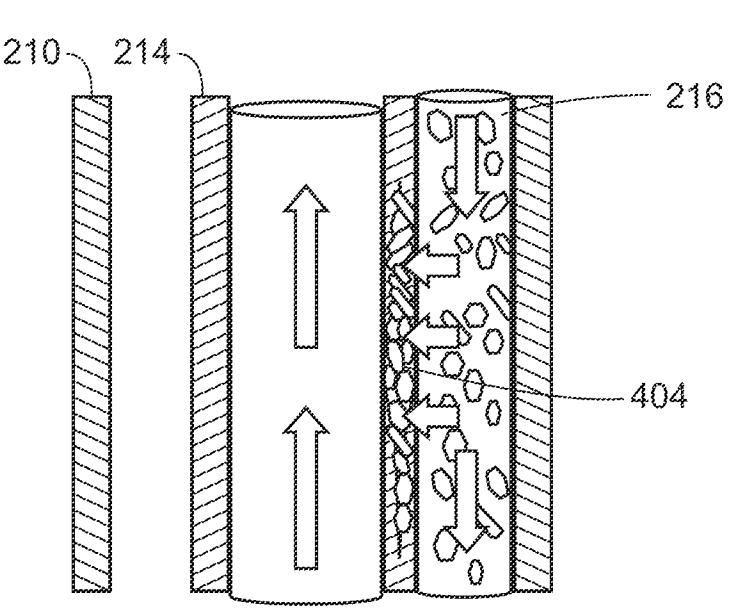
FIGS. 4A and 4B are schematic diagrams of plugging a leak in an inner wellbore tubular of the wellbore tubular assembly of FIG. 1.
Figure 4A:
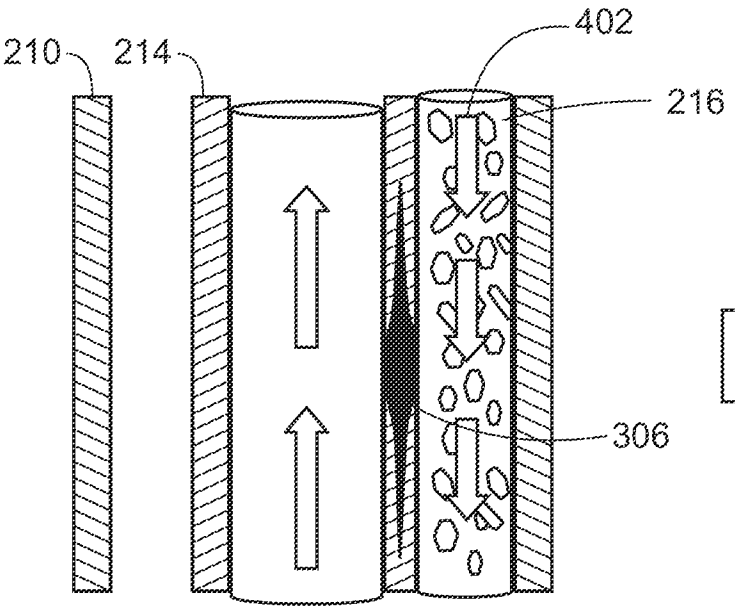

FIGS. 4A and 4B are schematic diagrams of plugging a leak in an inner wellbore tubular of the wellbore tubular assembly of FIG. 1. As described above with reference to FIG. 3, a crack 306 that forms in the wall of the inner wellbore tubular 214 causes hydrocarbons flowing through the inner wellbore tubular 214 to flow into the TTA 216 formed between the outer surface of the inner wellbore tubular 214 and the inner surface of the outdoor wellbore tubular 210. Upon determining that the crack 306 has formed, the wellbore operator can stop flow through the assembly 102, specifically through the inner wellbore tubular 214. The wellbore operator can pump from the surface 106 of the wellbore 100, in a downhole direction, and through the TTA 216, sealing material that can seal the crack 306 in the outer wall of the inner wellbore tubular 214. FIG. 4A schematically shows the sealing material 402 being pumped into the downhole direction and through the TTA 216. The sealing material 402 flows into the crack 306 and cures (e.g., hardens), thereby resulting in a sealed crack 404. Wellbore operations, specifically flow through the assembly 102 with the inner wellbore tubular 214 having the sealed crack 404, can then be resumed.

Figure 5:
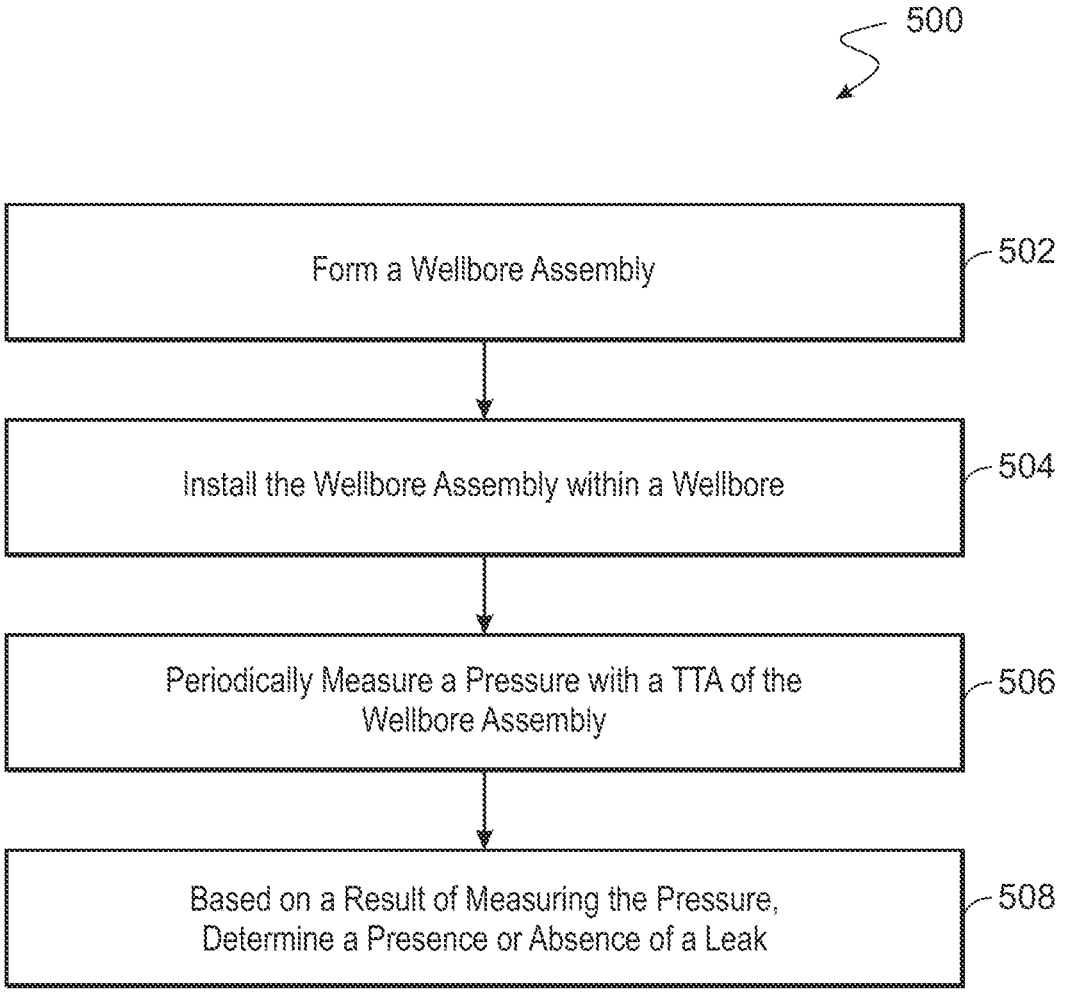
FIG. 5 is a flowchart of an example of a process of using the wellbore tubular assembly of FIG. 1.

FIG. 5 is a flowchart of an example of a process 500 of using the wellbore tubular assembly of FIG. 1. At 502, the wellbore assembly 102 is formed. To do so, and inner wellbore tubular 214 is positioned within a hollow volume defined by an outer wellbore tubular 210. When the inner wellbore tubular 214 is installed within the outer wellbore tubular 210, the TTA 216 is defined between an outer wall of the inner wellbore tubular 214 and an inner wall of the outer wellbore tubular 210. As described earlier, the two wellbore tubulars are attached to each other by attaching connections to the ends of the assembly 102. At 504, the wellbore assembly is installed within a wellbore. For example, the assembly 102 is installed within the wellbore 100. Any other well completions needed to perform wellbore operations, e.g., producing through the wellbore 100, can also be installed within the wellbore 100. Subsequently, the wellbore operations can be initiated. At 506, while performing wellbore operations within the wellbore 100, a pressure within the TTA 216 can be periodically measured. For example, a pressure cable 304 can be installed in the TTA 216 and can be coupled to a pressure gauge 302 installed at the surface 106 of the wellbore 100.

Based on a result of measuring the pressure, at 508, a presence or absence of a leak can be determined. For example, under normal operating conditions, wellbore fluids such as hydrocarbons flow through the inner volume defined by the inner wellbore tubular 214, and no hydrocarbons flow into the TTA 216. In such situations, pressure measured by the pressure gauge 302 remain substantially constant and at below a pressure threshold. If a crack 306 forms in the wall of the inner wellbore tubular 214, then hydrocarbons will flow from within the inner wellbore tubular 214 into the TTA 216. Such flow changes, e.g., increases, the pressure in the TTA 216. In such situations, pressure measured by the pressure gauge 302 changes indicating a leak into the TTA 216 caused by the formation of a crack 306 in the wall of the inner wellbore tubular 214. In some implementations, the pressure gauge 302 can be connected to a controller (not shown) which can be configured to transmit an alert (e.g., trigger an audio or visual alarm or both) in response to the pressure measured by the pressure gauge 302 exceeding the pressure threshold.

Thus, particular implementations of the subject matter have been described. Other implementations are within the scope of the following claims.

The invention claimed is:

1. A method comprising:

forming a wellbore assembly by:

installing a second wellbore tubular within a hollow volume defined by a first wellbore tubular, wherein the second wellbore tubular installed within the hollow volume defines a tubing-to-tubing annulus (TTA) between an outer wall of the second wellbore tubular and an inner wall of the first wellbore tubular, attaching a first connection at a first end of the wellbore assembly, the first connection attached to the first wellbore tubular and the second wellbore tubular, the first connection coupling the first end of the wellbore assembly to a wellbore tool, and attaching a second connection at a second end of the wellbore assembly opposite the first end of the wellbore assembly, the second connection attached to the first wellbore tubular and the second wellbore tubular, the second connection coupling the second end of the wellbore assembly to a wellbore tool;

installing the wellbore assembly within a wellbore;

while performing wellbore operations within the wellbore, periodically measuring a pressure within the TTA; and based on a result of periodically measuring the pressure within the TTA, determining a leak in the second wellbore tubular.

2. The method of claim 1, wherein periodically measuring the pressure within the TTA comprises:

installing a pressure cable within the TTA when forming the wellbore assembly; and coupling the pressure cable to a pressure gauge installed at a surface of the wellbore.

3. The method of claim 1, wherein based on the result of periodically measuring the pressure within the TTA, determining the leak in the second wellbore tubular comprises determining that the pressure within the TTA exceeds a pressure threshold.

4. The method of claim 3, wherein determining the leak in the second wellbore tubular comprises determining the leak at a first time instant, wherein the method comprises, based on the result of periodically measuring the pressure within the TTA, determining an absence of the leak in the second wellbore tubular at a second time instant different from the first time instant.

5. The method of claim 4, wherein determining the absence of the leak comprises determining that the pressure within the TTA does not exceed the pressure threshold.

6. The method of claim 1, wherein determining the leak in the second wellbore tubular comprises determining a crack in an outer wall of the second wellbore tubular, wherein the method comprises pumping, from a surface of the wellbore and into the TTA, a sealing material to seal the crack in the outer wall of the second wellbore tubular.

7. The method of claim 1, wherein performing wellbore operations within the wellbore comprises producing wellbore fluids comprising hydrocarbons through the wellbore assembly.

8. A wellbore assembly comprising:

a first wellbore tubular configured to be lowered into and installed within a wellbore, the first wellbore tubular having an inner diameter and defining a first hollow volume;

a second wellbore tubular configured to be lowered into and installed within the first hollow volume of the first wellbore tubular, the second wellbore tubular having an outer diameter smaller than the inner diameter of the first wellbore tubular, wherein the second wellbore tubular installed within the first hollow volume defines a tubing-to-tubing annulus (TTA) between an outer wall of the second wellbore tubular and an inner wall of the first wellbore tubular;

a pressure gauge coupled to the wellbore assembly to measure a pressure within the TTA;

a pressure cable positioned within the TTA and coupled to the pressure gauge;

a first connection at a first end of the wellbore assembly, the first connection attached to the first wellbore tubular and the second wellbore tubular, the first connection configured to couple the first end of the wellbore assembly to a wellbore tool; and a second connection at a second end of the wellbore assembly opposite the first end of the wellbore assembly, the second connection attached to the first wellbore tubular and the second wellbore tubular, the second connection configured to couple the second end of the wellbore assembly to a wellbore tool.

9. The wellbore assembly of claim 8, wherein the first wellbore tubular and the second wellbore tubular have the same length.

* * * * *